US012704085B2

(12) United States Patent
Disch et al.

(10) Patent No.: US 12,704,085 B2
(45) Date of Patent: Aug. 11, 2026

(54) BURNER FOR AN EXHAUST-GAS AFTERTREATMENT SYSTEM, EXHAUST-GAS AFTERTREATMENT SYSTEM FOR AN INTERNAL COMBUSTION ENGINE

(71) Applicant: Robert Bosch GmbH, Stuttgart (DE)

(72) Inventors: Christian Disch, Wimsheim (DE); Manuel Biedron, Moensheim (DE); Matthias Lausch, Bukarest (RO); Max Braunbeck, Lauffen Am Neckar (DE); Thorsten Klinkhammer, Asperg (DE); William Krein, Neckarzimmern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 18/872,665

(22) PCT Filed: May 15, 2023

(86) PCT No.: PCT/EP2023/062935
§ 371 (c)(1),
(2) Date: Jan. 17, 2025

(87) PCT Pub. No.: WO2023/237294
PCT Pub. Date: Dec. 14, 2023

(65) Prior Publication Data

US 2025/0361825 A1 Nov. 27, 2025

(30) Foreign Application Priority Data

Jun. 8, 2022 (DE) ..... 10 2022 205 806.2

(51) Int. Cl.
*F01N 3/20* (2006.01)
*F01N 3/025* (2006.01)

(52) U.S. Cl.
CPC ..... *F01N 3/2033* (2013.01); *F01N 3/0253* (2013.01); *F01N 2240/14* (2013.01)

(58) Field of Classification Search
CPC ..... F01N 3/2033; F01N 3/2053; F01N 3/36; F01N 2240/14
See application file for complete search history.

(56) References Cited

U.S. PATENT DOCUMENTS 5,606,856 A * 3/1997 Linder ..... B01D 53/9495 60/301
2006/0070374 A1* 4/2006 Gaiser ..... F01N 3/36 60/289
2022/0307401 A1* 9/2022 Uhlenbrock ..... B01D 53/9454

FOREIGN PATENT DOCUMENTS

DE 19504208 A1 8/1995
EP 900923 A2 * 3/1999
(Continued)

OTHER PUBLICATIONS

International Search Report for PCT/EP2023/062935, Issued Jul. 17, 2023.

*Primary Examiner* — Ngoc T Nguyen
(74) *Attorney, Agent, or Firm* — NORTON ROSE FULBRIGHT US LLP

(57) ABSTRACT

A burner for an exhaust-gas aftertreatment system. The burner includes a housing forming a combustion chamber. The housing has an outlet which is or can be connected to an exhaust-gas line of the exhaust-gas aftertreatment system. The burner further includes a fuel feed device for feeding fuel into the combustion chamber; a fresh-air feed device for feeding fresh air into the combustion chamber; and an ignition element for igniting a fresh-air/fuel mixture located in the combustion chamber. It is provided that the housing is designed such that the combustion chamber has a cylindrical main portion and a bulge protruding radially outward
(Continued)

from the main portion, and that the ignition element is arranged in the bulge.

15 Claims, 6 Drawing Sheets

(56) References Cited

FOREIGN PATENT DOCUMENTS

| | | | |
|---|---|---|---|
| EP | 1645731 | A1 | 4/2006 |
| EP | 2199678 | A2 | 6/2010 |
| JP | 2012107634 | A | 6/2012 |

* cited by examiner

BURNER FOR AN EXHAUST-GAS AFTERTREATMENT SYSTEM, EXHAUST-GAS AFTERTREATMENT SYSTEM FOR AN INTERNAL COMBUSTION ENGINE

FIELD

The present invention relates to a burner for an exhaust-gas aftertreatment system, including a housing forming a combustion chamber, wherein the housing has an outlet which is or can be connected to an exhaust-gas line of the exhaust-gas aftertreatment system; a fuel feed device for feeding fuel into the combustion chamber; a fresh-air feed device for feeding fresh air into the combustion chamber; and an ignition element for igniting a fresh-air/fuel mixture located in the combustion chamber.

The present invention also relates to an exhaust-gas aftertreatment system for an internal combustion engine.

BACKGROUND INFORMATION

For achieving current emission limits, the use of catalysts in exhaust-gas aftertreatment systems of internal combustion engines is described in the related art. The catalysts make a conversion of gaseous pollutants, such as NOx, HC and CO, into harmless products such as N2, H2O and CO2 possible. In order for these catalytic reactions to proceed sufficiently quickly, the temperature of the catalyst should exceed the so-called light-off temperature of typically 300° C. to 400° C. In order to quickly achieve this state, in particular in the case of a cold start of the internal combustion engine, so-called internal engine catalyst heating measures are often used. In this case, the degree of efficiency of the internal combustion engine is worsened by late ignition angles, whereby the exhaust-gas temperature and the enthalpy input into the catalyst are increased.

In addition to these internal engine catalyst heating measures, external catalyst heating measures are also described in the related art. For example, German Patent Application No. DE 195 04 208 A1 describes an exhaust-gas aftertreatment system in which a burner is assigned to the exhaust-gas line of the exhaust-gas aftertreatment system. The burner has a housing forming a combustion chamber. The burner also has a fuel feed device and a fresh-air feed device. The fuel feed device is designed to feed fuel to the combustion chamber. The fresh air feed device is designed to feed fresh air into the combustion chamber. When the burner is in operation, the fresh air and the fuel flow through the combustion chamber as a fresh air-fuel mixture. Furthermore, an ignition element for igniting the fresh-air/fuel mixture located in the combustion chamber is present. An outlet of the housing is fluidically connected to the exhaust-gas line of the exhaust-gas aftertreatment system. Fresh air-fuel mixture burned in the combustion chamber is accordingly fed through the outlet into the exhaust-gas line in order to heat the exhaust-gas line and in particular a catalyst of the exhaust-gas line.

SUMMARY

A burner according to the present invention may have an advantage that the burner has a particularly advantageous ignition behavior. In particular, the ignition of the fresh air-fuel mixture is realized more quickly in comparison to conventional burners, so that the catalyst can also be heated more quickly. According to an example embodiment of the present invention, it is provided that the housing is designed such that the combustion chamber has a cylindrical main portion and a bulge protruding radially outward from the main portion, and that the ignition element is arranged in the bulge. When the terms "axial" and "radial" are used in the context of the disclosure, such terms refer to the longitudinal center axis of the cylindrical main portion, unless a different reference is expressly disclosed. According to the present invention, the combustion chamber thus has at least two portions, the cylindrical main portion and the bulge protruding from the main portion. When the burner is in operation, the fresh-air/fuel mixture typically flows through the cylindrical main portion in a spiral or swirl flow. At an opening area of the bulge that faces the main portion, a momentum exchange takes place between the swirl flow in the main portion and the gas volume of the bulge. This generates a recirculation flow, which rotates in the opposite direction in relation to the swirl flow, in the bulge. The recirculation flow in the bulge has a reduced flow velocity in comparison to the swirl flow in the main portion. Due to the lower flow velocity, the convective heat transfer from the ignition element is reduced in comparison to the arrangement of the ignition element in the main portion. Increased convective heat transfer from the ignition element would be detrimental to the ignition behavior of the burner. The fuel feed device is preferably designed to meter the fuel directly into the combustion chamber. The recirculation flow in the bulge causes the fresh-air/fuel mixture to remain longer in the region of the ignition element. The longer residence time in the region of the ignition element means that effective evaporation of the fuel can take place. Preferably, the ignition element is arranged only in the bulge. Thus, the ignition element does not project into the main portion of the combustion chamber and is therefore arranged outside the main portion. Particularly preferably, the ignition element is arranged such that the recirculation flow in the bulge is concentric with the ignition element. The recirculation flow thus flows around the ignition element.

According to a preferred example embodiment of the present invention, it is provided that the housing has a first housing part forming the main portion and a second housing part forming the bulge, wherein the first and the second housing part are manufactured separately from each other, and wherein the second housing part is arranged in an aperture in a housing wall of the first housing part. This design of the housing is simple to realize in terms of manufacturing technology and is therefore preferred. According to an alternative embodiment, the first housing part and the second housing part are formed integrally with each other. If reference is made below to the first and/or the second housing part, the housing parts can be manufactured separately from each other or formed integrally with each other.

According to a preferred example embodiment of the present invention, it is provided that the first housing part has a circular cross-section. Accordingly, the main portion also has a circular cross-section. In a cross-section, the cut surface is aligned perpendicularly to the longitudinal center axis of the cylindrical main portion. If the first housing part has a circular cross-section, a particularly uniform swirl flow is realized in the main portion when the burner is in operation. However, the first housing part can also have a cross-section that deviates from a circular shape. For example, according to an alternative embodiment, the first housing part has an oval cross-section or a rectangular cross-section with rounded corners.

According to an example embodiment of the present invention, preferably, the second housing part has a cross-section with a C-shaped profile. The opening of the C-shaped profile faces the main portion. If the second housing part has a cross-section with a C-shaped profile, the recirculation flow in the bulge is formed particularly reliably when the burner is in operation. Preferably, an inner surface forming the bulge of the second housing part has an in particular continuously curved profile. This is particularly advantageous for forming a uniform recirculation flow. Preferably, the second housing part is pot-shaped, so that the bulge is trough-shaped in this case.

According to a preferred example embodiment of the present invention, it is provided that the bulge extends in the circumferential direction of the main portion over a circumferential angle of 10° to 50°. Thus, the bulge does not extend completely along the circumference of the cylindrical main portion, but only in certain regions. If the bulge extends over a circumferential angle of 10° to 50°, the recirculation flow in the bulge is formed particularly reliably when the burner is in operation. Particularly preferably, the bulge extends over a circumferential angle of 20° to 30°. The circumferential angle over which the bulge extends corresponds to the opening angle of the bulge, in relation to the longitudinal center axis of the main portion.

According to a preferred example embodiment of the present invention, it is provided that an axial extension of the bulge is smaller than an axial extension of the main portion. The bulge thus extends in the axial direction only in certain regions along the main portion. This ensures that the formation of a uniform swirl flow in the main portion is hardly affected by the bulge.

According to a preferred example embodiment of the present invention, it is provided that a ratio of the volume of the main portion to the volume of the bulge is 200:1 to 50:1. Such a ratio is particularly advantageous with regard to the ignition behavior of the burner. Preferably, the ratio of the volume of the main portion to the volume of the bulge is 175:1 to 100:1. The ratio 150:1 is particularly preferred.

According to a preferred example embodiment of the present invention, it is provided that a yaw angle of the ignition element is in an angular range that begins with 0° and ends with 45°, wherein the yaw angle describes a rotation of the longitudinal center axis of the ignition element relative to the longitudinal center axis of the main portion about a vertical axis, which is aligned perpendicularly to the longitudinal center axis of the main portion and runs through the longitudinal center axis of the main portion and through the ignition element, in particular through a center of the ignition element. With such an alignment of the ignition element, the fresh-air/fuel mixture is advantageously fed to the ignition element when the burner is in operation. Preferably, the yaw angle is in an angular range that begins with 10° and ends with 30°. As mentioned above, the fresh-air/fuel mixture typically flows through the main portion as a swirl flow. If the yaw angle is between 10° and 30°, it can be achieved that the flow direction of the fresh-air/fuel mixture flowing into the bulge is perpendicular to the longitudinal center axis of the ignition element. This is particularly advantageous since a symmetrical recirculation of the fresh-air/fuel mixture around the spark plug can be achieved. The yaw angle is particularly preferably 20°. Preferably, the second housing part has two side walls aligned in parallel with the longitudinal center axis of the ignition element, wherein the ignition element is arranged between the side walls. Since the side walls are aligned in parallel with the ignition element, the formation of the recirculation flow is particularly advantageously supported by the side walls. If the yaw angle is not equal to 0°, the two side walls are also accordingly aligned obliquely. Preferably, in addition to the two side walls, there are two further side walls which are aligned perpendicularly to the side walls aligned in parallel with the longitudinal center axis of the ignition element. In particular, the yaw angle is 0°. This is structurally particularly simple to realize.

According to a preferred example embodiment of the present invention, it is provided that a pitch angle of the ignition element is in an angular range that begins with 0° and ends with 70°, wherein the pitch angle describes a rotation of the longitudinal center axis of the ignition element relative to the longitudinal center axis of the main portion about a transverse axis, which is aligned perpendicularly to the longitudinal center axis of the main portion and the vertical axis and runs through the ignition element. In principle, a small pitch angle is advantageous since the installation space of the burner in the radial direction is small as a result. In particular, the pitch angle is 0°. As a result, the smallest possible radial installation space can be realized.

However, by using a pitch angle other than 0°, the contact between the ignition element and the fresh-air/fuel mixture can be optimized. Particularly preferably, the pitch angle is in an angular range that begins with 20° and ends with 30°.

Preferably, the ignition element is arranged such that a longitudinal center axis of the ignition element is aligned in parallel with the longitudinal center plane of the main portion. This results in the advantage that a combustion chamber or a housing with a small radial extension can be realized. Since the yaw angle is 0°, this embodiment is also structurally simple to realize.

According to a preferred example embodiment of the present invention, it is provided that the housing has a rounding at least one transition from the main portion to the bulge. As a result, the entry of the fresh-air/fuel mixture into the bulge is facilitated. As mentioned above, there are preferably two side walls aligned in parallel with the longitudinal center axis of the ignition element. Preferably, a rounding is formed in at least one of these side walls, namely at the transition from the main portion to the bulge. As mentioned above, there are preferably also two further side walls which are aligned perpendicularly to the side walls aligned in parallel with the longitudinal center axis of the ignition element. Preferably, a rounding is also formed in at least one of these side walls, namely at the transition from the main portion to the bulge. According to an alternative embodiment, the housing is designed without a rounding at the transitions from the main portion to the bulge. As a result, the production of the housing is simplified.

According to a preferred example embodiment of the present invention, it is provided that the ignition element is a glow plug. It has been shown that an ignition element designed as a glow plug is particularly advantageous with regard to quick ignition of the fresh-air/fuel mixture. A further key advantage of an ignition element designed as a glow plug is the resistance to moisture. Due to the dead volume, a burner of an exhaust-gas aftertreatment system in passive operation tends to allow condensate to collect in the combustion chamber and also in the fresh-air feed device. In this case, if the burner is started, this condensate can also be transported to the ignition element. However, if the ignition element is designed as a glow plug, the ignition element is only affected slightly by the condensate or moisture. The ignition element is particularly preferably a ceramic glow plug. Ceramic glow plugs can reach particularly high temperatures, which is advantageous with regard to the ignition behavior of the burner. According to an alternative embodiment, it is preferably provided that the ignition element is a spark plug.

According to an example embodiment of the present invention, preferably, the fresh-air feed device has a sleeve-shaped fresh-air feed chamber, wherein the fresh-air feed chamber radially encloses the first housing part, and wherein the second housing part projects radially through the fresh-air feed chamber. The fresh air thus flows past the housing in the region of the sleeve-shaped fresh-air feed chamber, which has the result that the fresh air is heated by waste heat from the housing before the fresh air is then fed to the combustion chamber. As a result, a particularly stable operation of the burner is ensured.

According to a preferred example embodiment of the present invention, it is provided that the fuel feed device and the fresh air feed device together form a two-fluid nozzle. If fresh air and fuel are fed into the combustion chamber through the two-fluid nozzle, the fuel is broken up into fine droplets by the fresh air so that the fuel is finely distributed in the fresh air-fuel mixture. As a result, the evaporation of the fuel by the ignition element can be accelerated, as a result of which ultimately the ignition of the fresh-air/fuel mixture is also accelerated.

An exhaust-gas aftertreatment system according to the present invention for an internal combustion engine includes the burner according to the present invention. This also results in the advantages mentioned above. Further preferred features and combinations of features result from what was described above and from the rest of the disclosure herein. Preferably, the exhaust-gas aftertreatment system has an exhaust-gas line having a catalyst, wherein the exhaust-gas line is fluidically connected to the combustion chamber through the outlet of the housing of the burner.

The present invention is explained in more detail below with reference to the figures.

DETAILED DESCRIPTION OF EXAMPLE EMBODIMENTS

Figure 1:
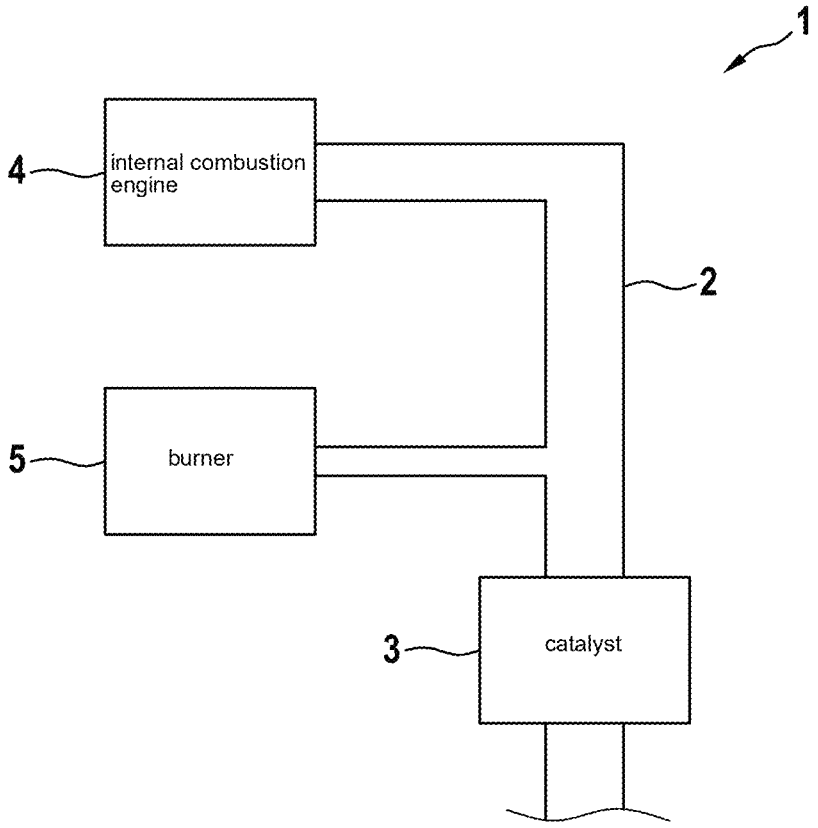
FIG. 1 shows an exhaust-gas aftertreatment system in a schematic representation, according to an example embodiment of the present invention.

FIG. 1 shows an exhaust-gas aftertreatment system 1 in a schematic representation. The exhaust-gas aftertreatment system 1 has an exhaust-gas line 2 having a catalyst 3. The exhaust-gas aftertreatment system 1 is assigned to an internal combustion engine 4 of a motor vehicle not shown in detail. An outlet of the internal combustion engine 4 is fluidically connected to the exhaust-gas line 2, so that exhaust gas arising during operation of the internal combustion engine 4 is fed to the exhaust-gas line 2. The exhaust gas of the internal combustion engine 4 flows through the catalyst 3 of the exhaust-gas line 2, wherein the catalyst 3 converts gaseous pollutants in the exhaust gas, such as NOx, HC or CO, into harmless products. The efficiency of the catalyst 3 corresponds to the temperature of the catalyst 3. In particular, at catalyst temperatures below a so-called light-off temperature, the aforementioned pollutants may not be completely converted by the catalyst 3. This may, for example, occur during a cold start of the internal combustion engine 4.

Figure 2:
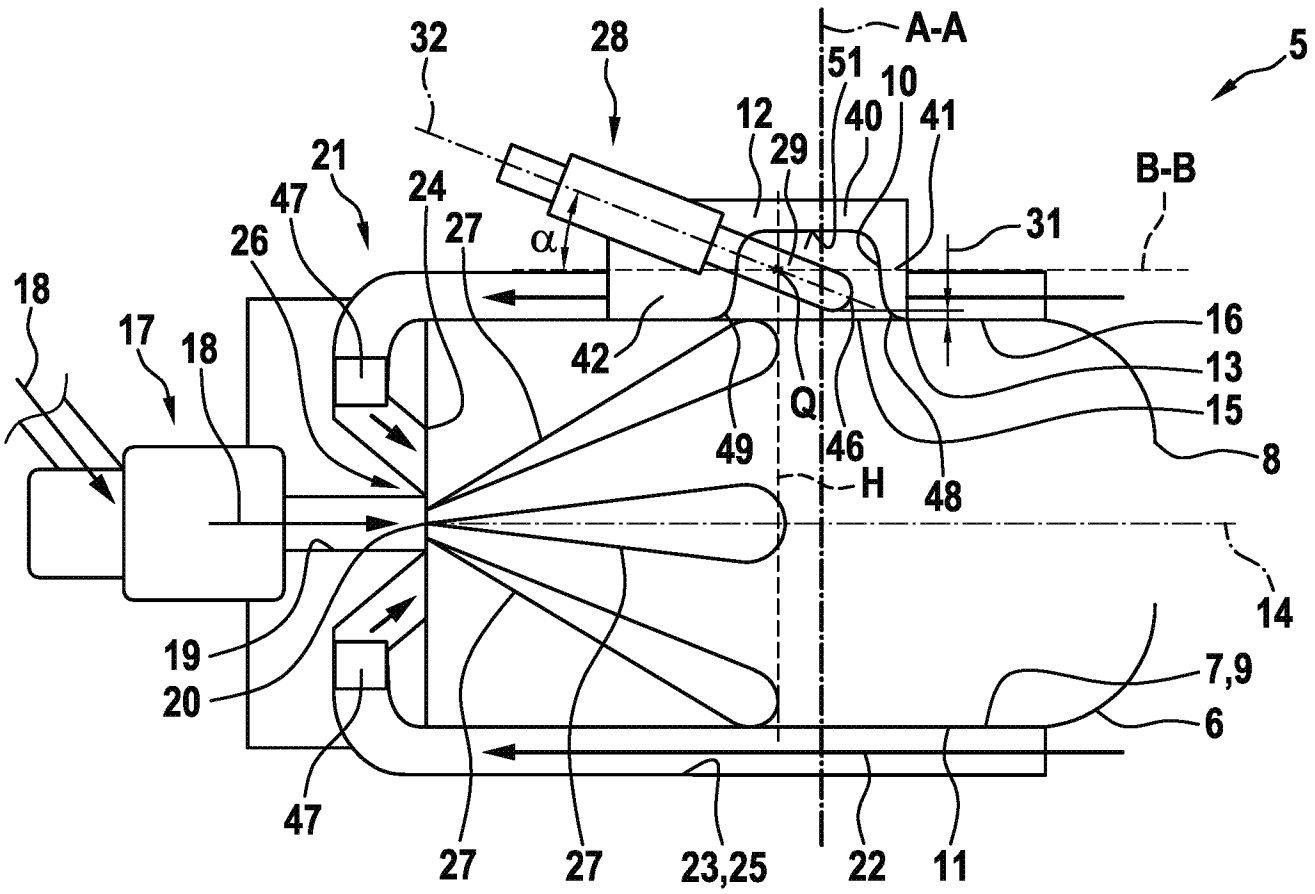
FIG. 2 is a sectional view of a burner of the exhaust-gas aftertreatment system, according to an example embodiment of the present invention.
Figure 3:
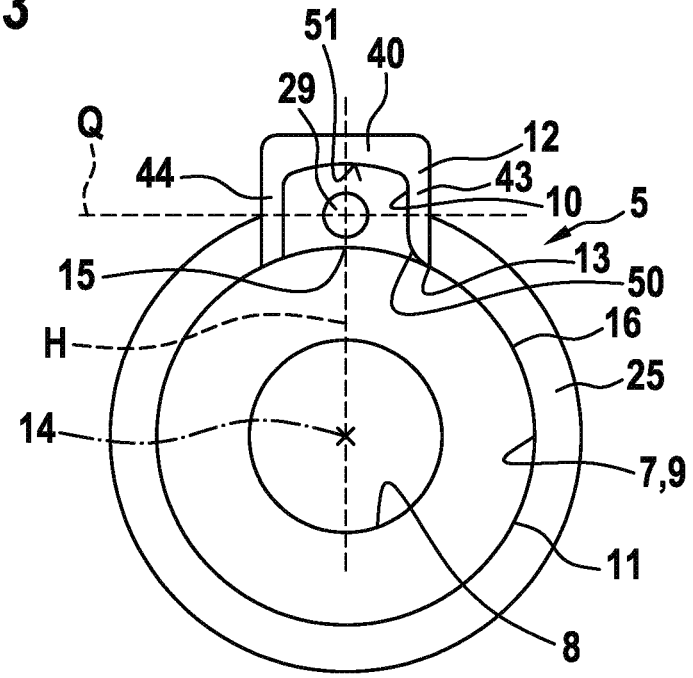
FIG. 3 is a further sectional view of the burner, according to an example embodiment of the present invention.
Figure 4:
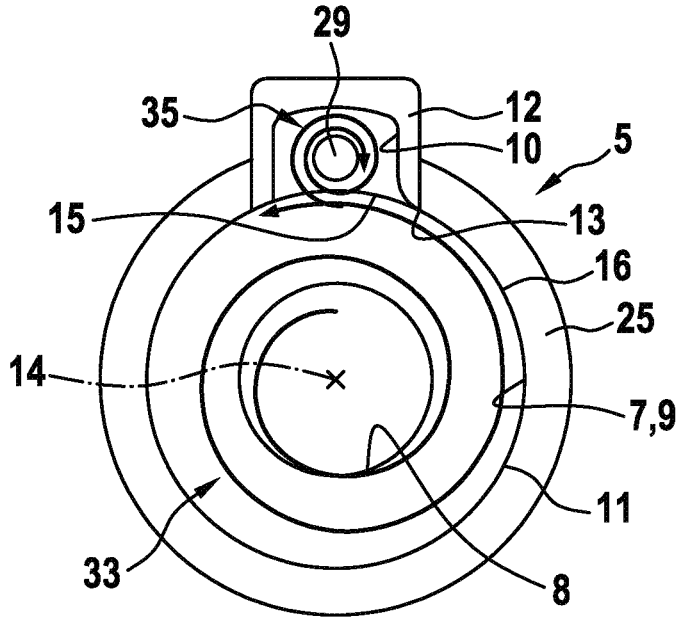
FIG. 4 is a further sectional view of the burner, according to an example embodiment of the present invention.
Figure 5:
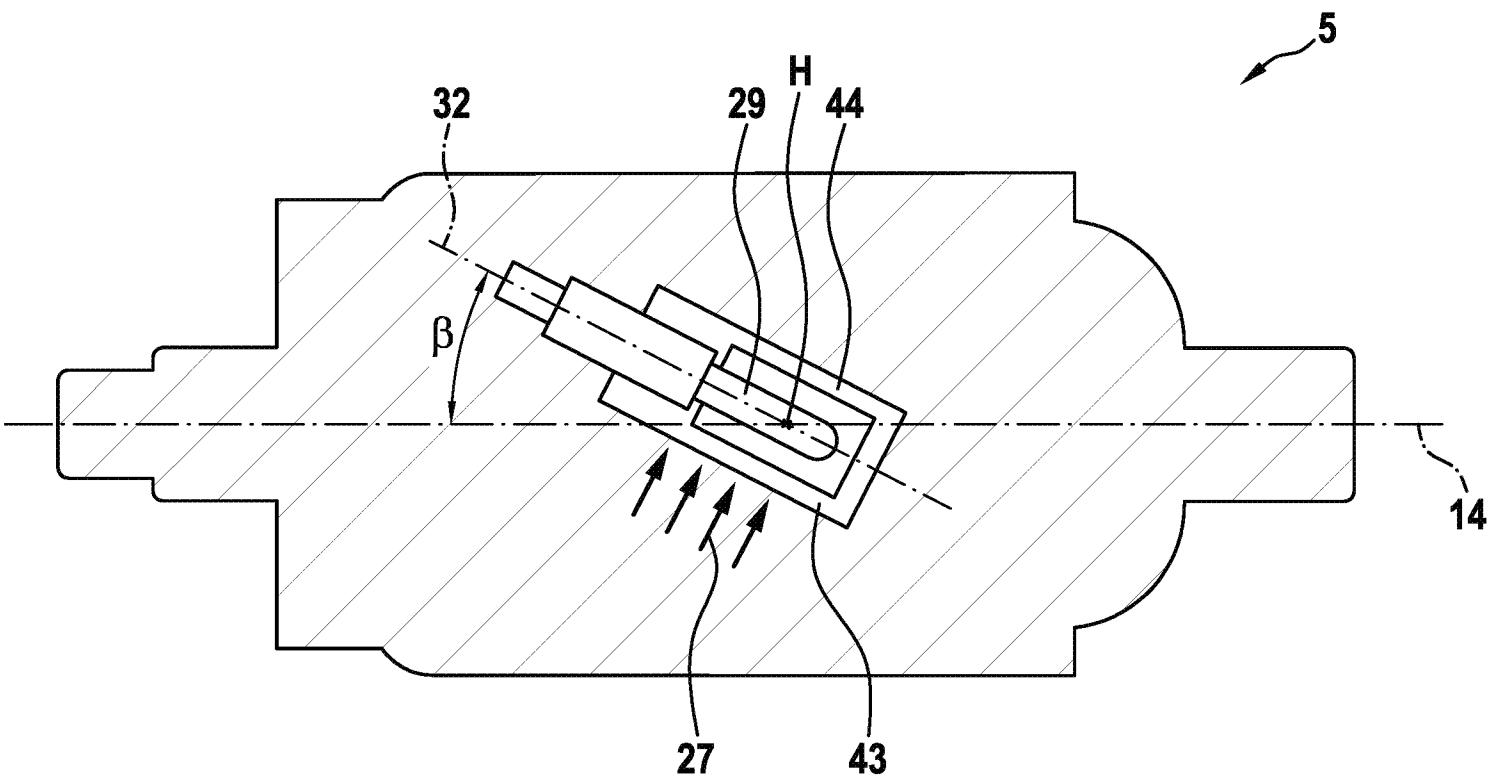
FIG. 5 is a further sectional view of the burner, according to an example embodiment of the present invention.

In order to accelerate the heating of the catalyst 3, in particular during a cold start of the internal combustion engine 4, the exhaust-gas aftertreatment system 1 has a burner 5. In the exhaust-gas aftertreatment system 1 shown schematically in FIG. 1, only one catalyst 3 is present and the burner 5 is fluidically connected to the exhaust-gas line 2 upstream of the catalyst 3. Preferably, the exhaust-gas aftertreatment system 1 has two catalysts 3 connected in series, wherein the burner 5 is in this case fluidically connected to the exhaust-gas line 2 upstream of the catalysts 3 or between the catalysts 3. The design of the burner 5 is explained in more detail below with reference to FIGS. 2, 3, 4, and 5. For this purpose, FIG. 2 is a longitudinal section of the burner 5. FIG. 3 is a cross-section of the burner 5 along the cross-sectional plane A-A shown in FIG. 2. FIG. 4 is a further cross-section of the burner 5 along the cross-sectional plane A-A shown in FIG. 2. FIG. 5 is a further sectional view of the burner 5, namely along the section plane B-B shown in FIG. 2.

The burner 5 has a housing 6 forming a combustion chamber 7. An outlet 8 of the housing 6 is fluidically connected to the exhaust-gas line 2. A fresh air-fuel mixture burned in the combustion chamber 7 can thus be fed into the exhaust-gas line 2 in order to heat the catalyst 3 thereby. The housing 6 is designed or shaped such that the combustion chamber 7 has a cylindrical main portion 9 and a bulge 10 protruding radially outward from the main portion 9 in relation to a longitudinal center axis 14 of the main portion 9. The housing 6 has a first housing part 11 forming the main portion 9. In the present case, the first housing part 11 has the outlet 8. The first housing part 11 is also cylindrical, wherein the first housing part 11 tapers in the region of the outlet 8. The housing 6 also has a second housing part 12 forming the bulge 10. The second housing part 12 is manufactured separately from the first housing part 11 and is arranged in an aperture 13 in a housing wall 16 of the first housing part 11. In the present case, the second housing part 12 is pot-shaped. The second housing part 12 is formed by a bottom 40 and four side walls 41, 42, 43, and 44. A first side wall 41 is opposite a second side wall 42. A third side wall 43 is opposite a fourth side wall 44, wherein the side walls 43 and 44 are not visible in FIG. 1 since they are outside the section plane. As can be seen in the figures, an inner surface 51 forming the bulge 10 of the second housing part 12 has a curved profile, so that the side walls 41, 42, 43, and 44 merge continuously into the bottom 40. There are therefore roundings at the transitions from the side walls 41, 42, 43, and 44 to the bottom 40. Alternatively, the transitions can also be designed without a rounding. In this case, the side walls 41, 42, 43, and 44 abruptly merge into the bottom 40. A maximum axial extension of the cylindrical main portion 9 is greater than a maximum axial extension of the bulge 10. The bulge 10 is thus limited to an axial portion of the main portion 9.

The housing 6 has multiple roundings, each of which is located at a transition from the main portion 9 to the bulge 10. As can be seen in FIG. 1, a rounding 48 and 49 is formed in the side walls 41 and 42, respectively. As can be seen in FIG. 2, for example, a rounding 50 is also formed in the third side wall 43. In the present case, the fourth side wall 44 is without a rounding, so that an edge is present at a transition from the main portion 9 to the bulge 10.

As can be seen in FIGS. 3 and 4, the first housing part 11 has a circular cross-section in the present case. Accordingly, the main portion 9 also has a circular cross-section. The second housing part 12 has a cross-section with a C-shaped profile, wherein an opening of the C-shaped profile faces the main portion 9. The bulge 10 extends in the circumferential direction of the main portion 9 only in portions along the main portion 9. In the present case, the bulge 10 extends in the circumferential direction over a circumferential angle of approximately 25° along the main portion 9. The ratio of the volume of the main portion 9 to the volume of the recess 10 is preferably 200:1 to 50:1, preferably 175:1 to 100:1, particularly preferably 150:1. This volume ratio is not exactly shown in the figures, which is due to the only schematic representation of the burner 5.

The burner 5 also has a fuel feed device 17, which is designed as a fuel injector 17 in the present case. The fuel feed device 17 is designed to feed fuel 18 to the combustion chamber 7. In the present case, the fuel feed device 17 is designed to meter the fuel 18 directly into the combustion chamber 7. For this purpose, the fuel feed device 17 has a fuel line 19, which is directly connected to the combustion chamber 7 through a fuel inlet 20. The burner 5 also has a fresh-air feed device 21, which is designed to feed fresh air 22 to the combustion chamber 7. For this purpose, the fresh-air feed device 21 has a fresh-air line 23, which is connected to the combustion chamber 7 through a fresh-air inlet 24. The fuel inlet 20 and the fresh-air inlet 24 are axially opposite the outlet 8. The fresh-air line 23 has a sleeve-shaped fresh-air feed chamber 25, which radially encloses the first housing part 11. The second housing part 12 projects radially through the fresh-air feed chamber 25. In the present case, the fuel feed device 17 and the fresh-air feed device 21 together form a two-fluid nozzle 26. If fuel 18 and fresh air 22 are fed to the combustion chamber 7 through the two-fluid nozzle 26, the fuel 18 is broken up into fine droplets by the fresh air 22, so that a fresh-air/fuel mixture 27 is obtained, in which the fuel 18 is finely distributed.

The burner 5 also has an ignition element 28 for igniting the fresh-air/fuel mixture 27 located in the combustion chamber 7. The ignition unit 28 has an ignition element 29 arranged in the bulge 10. The ignition element 29 projects through an aperture in the second housing part 12 into the bulge 10. The ignition element is aligned in parallel with the third side wall 43 and the fourth side wall 44. The ignition element 29 is arranged only in the bulge 10 of the combustion chamber 7, so that the ignition element 29 does not project into the cylindrical main portion 9. Rather, a free end 46 of the ignition element 29 has a retracted installation position relative to the main portion 9. There is thus a radial distance 31 between the ignition element 29 and the cylindrical main portion 9. In the present case, the ignition element 29 is a glow plug 29, particularly preferably a ceramic glow plug 29. However, the ignition element 29 can also be a different type of ignition element 29. According to a further exemplary embodiment, the ignition element 29 is designed as a spark plug.

According to the exemplary embodiment shown in FIG. 2, the ignition element 29 is arranged such that a longitudinal center axis 32 of the elongated ignition element 29 is aligned obliquely to the longitudinal center axis 14 of the main portion 9.

The alignment of the ignition element 29 relative to the longitudinal center axis 14 of the main portion 9 is described by a pitch angle α of the ignition element 29 and a yaw angle β of the ignition element 29. The yaw angle β describes a rotation of the longitudinal center axis 32 of the ignition element 29 relative to the longitudinal center axis 14 of the main portion 9 about a vertical axis H, which is aligned perpendicularly to the longitudinal center axis 14 of the main portion 9 and runs through the longitudinal center axis 14 of the main portion and through the ignition element 29. The pitch angle α describes a rotation of the longitudinal center axis 32 of the ignition element 29 relative to the longitudinal center axis 14 of the main portion 9 about a transverse axis Q, which is aligned perpendicularly to the longitudinal center axis 14 of the main portion 9 and the vertical axis H and runs through the ignition element 29.

According to the exemplary embodiment shown in FIG. 1, the pitch angle α is approximately 20°. However, a different pitch angle α can also be provided. Preferably, the pitch angle α is in an angular range that begins with 0° and ends with 70°, particularly preferably in an angular range that begins with 20° and ends with 30°.

The yaw angle β of the ignition element 29 can be seen in FIG. 5. In the present case, the yaw angle α is approximately 30°. Preferably, the yaw angle β is in an angular range that begins with 0° and ends with 45°, particularly preferably in an angular range that begins with 10° and ends with 30°. If the yaw angle β is not equal to 0°, the third side wall 43 and the fourth side wall 44 are aligned obliquely according to the yaw angle β.

The functionality of the burner 5 is explained in more detail below with reference to FIG. 4. FIG. 4 shows the flow direction of the fresh-air/fuel mixture 27 in the combustion chamber 7. As can be seen in FIG. 4, the fresh-air/fuel mixture 27 flows in the sense of a swirl flow 33 through the cylindrical main portion 9 of the combustion chamber 7. The swirl flow 33 is generated by a swirl grid 47, which is arranged in the fresh-air line 23 upstream of the fresh-air inlet 24. At an opening area 15 of the bulge 10 that faces the main portion 9, a momentum exchange takes place between the swirl flow 33 in the main portion 9 and the gas volume of the bulge 10. The momentum exchange is facilitated by the rounding 50 in the third side wall 43. Due to the advantageous yaw angle β, the flow direction of the fresh-air/fuel mixture 27 is perpendicular to the longitudinal center axis 32 of the ignition element 29, as can be seen in FIG. 5. The momentum exchange generates, in the bulge 10, a recirculation flow 35, which rotates in the opposite direction in relation to the swirl flow 33, in the bulge 10. The recirculation flow 35 has a reduced flow velocity in comparison to the swirl flow 33. Due to the lower flow velocity in the bulge 10, the convective heat transfer from the ignition element 29 is reduced in comparison to an arrangement of the ignition element 29 in the main portion 9. As a result, effective heating of the fresh-air/fuel mixture 27 can be achieved by means of the ignition element 29. This causes the fuel 18 of the fresh-air/fuel mixture 27 to evaporate quickly in the region of the bulge 10, which ultimately leads to quick ignition of the fresh-air/fuel mixture 27 at the same glow plug 29.

Figure 6:
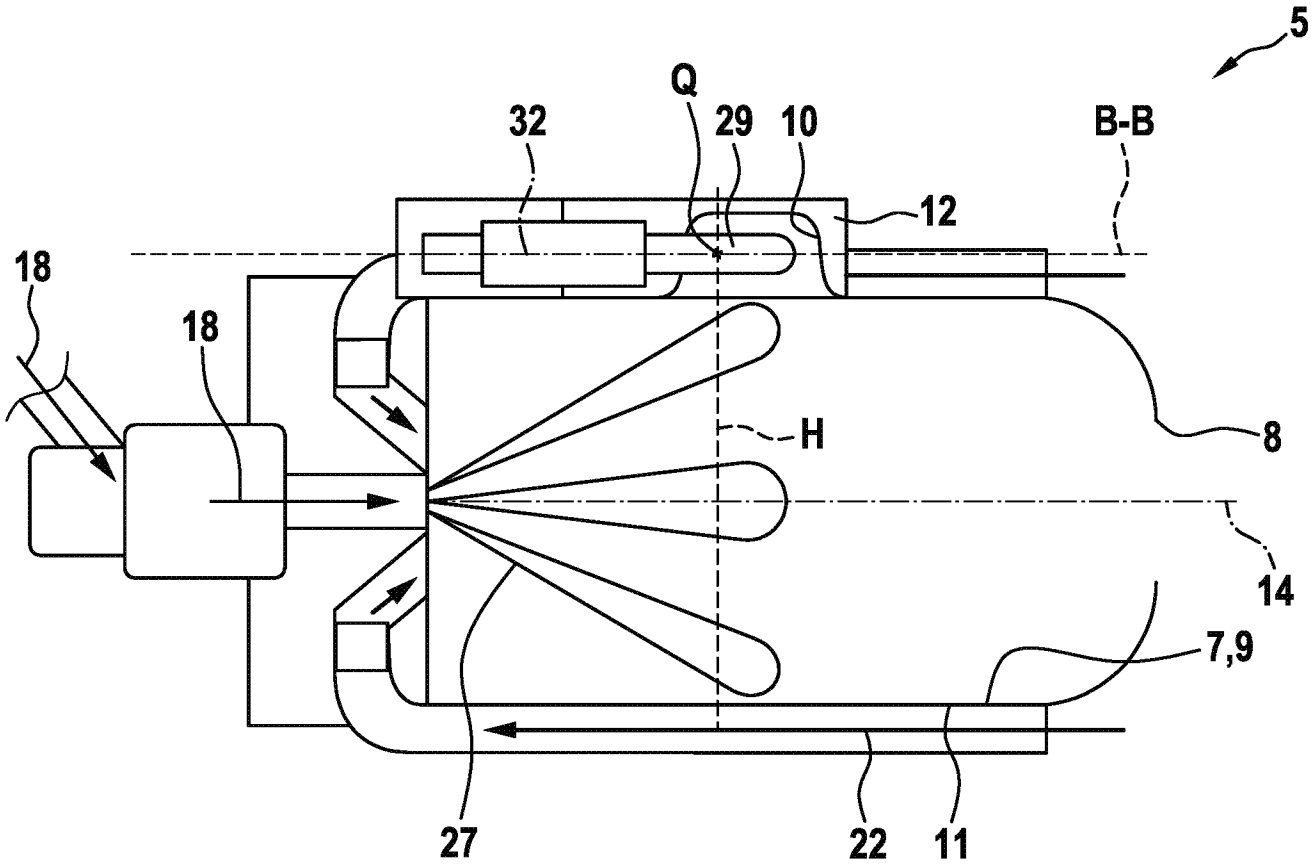
FIG. 6 is a sectional view of the burner according to a further exemplary embodiment of the present invention.

FIG. 6 is a longitudinal section through the burner 5 according to a further exemplary embodiment. In the burner 5 shown in FIG. 6, the pitch angle α is 0°. This results in the advantage that the radial extension of the combustion chamber 5 can be reduced.

Figure 7:
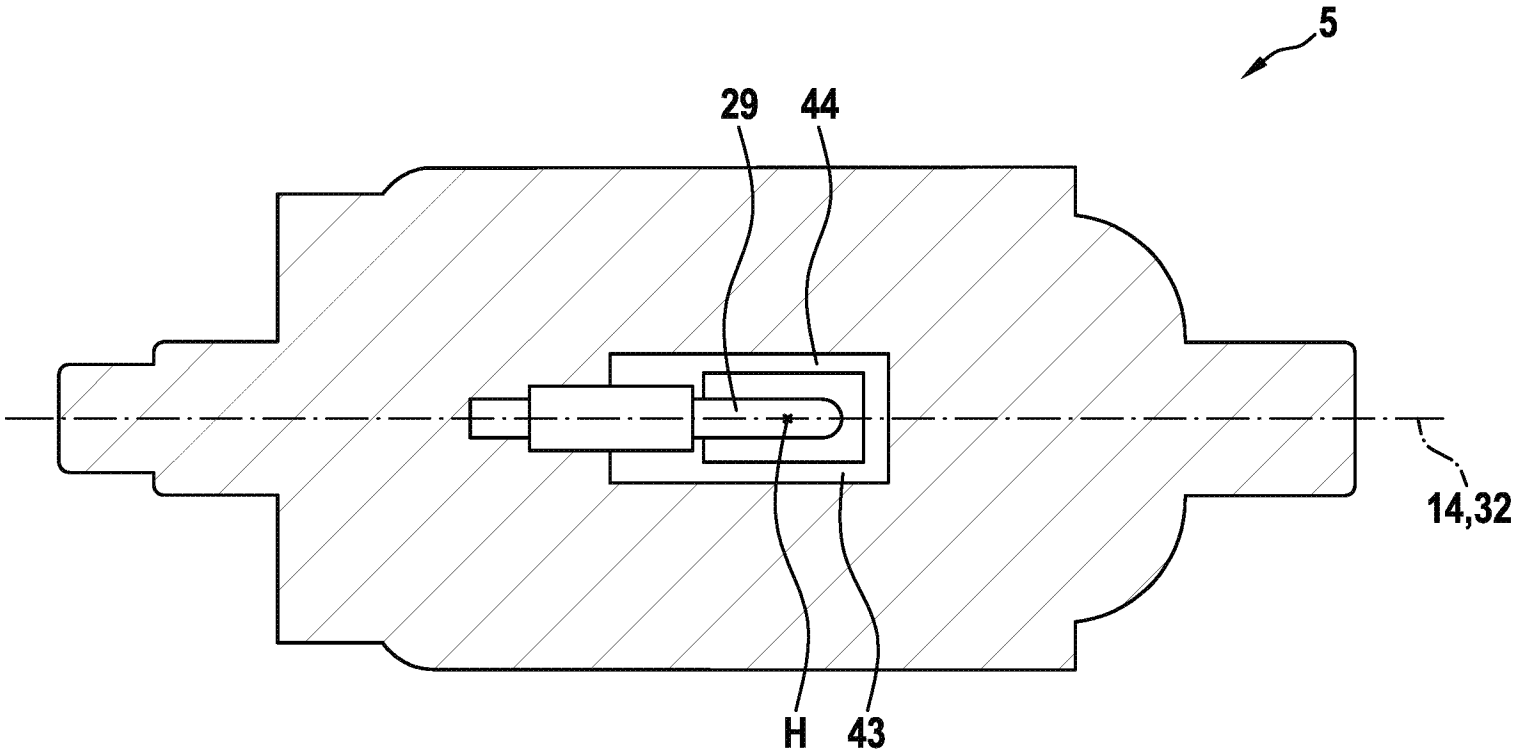
FIG. 7 is a sectional view of the burner according to a further exemplary embodiment of the present invention

FIG. 7 is a sectional view of the burner 5 according to a further exemplary embodiment. In the burner 5 shown in FIG. 7, the yaw angle β is 0°. This embodiment of the burner 5 is structurally particularly simple to realize.

The invention claimed is:

1. A burner for an exhaust-gas aftertreatment system, comprising:

a housing forming a combustion chamber, the housing having an outlet which is or can be connected to an exhaust-gas line of the exhaust-gas aftertreatment system;

a fuel feeder configured to feed fuel into the combustion chamber;

a fresh-air feeder configured to feed fresh air into the combustion chamber; and an ignition configured to ignite a fresh-air/fuel mixture located in the combustion chamber;

wherein the housing is configured such that the combustion chamber has a cylindrical main portion and a bulge protruding radially outward from the main portion, and the ignition is arranged in the bulge, wherein the combustion chamber is configured such that a fresh-air/fuel mixture introduced into the cylindrical main portion flows in a swirl flow, and the bulge is configured to generate a recirculation flow that rotates in the opposite direction relative to the swirl flow.

2. The burner according to claim 1, wherein the housing has a first housing part forming the main portion and a second housing part forming the bulge, wherein the first and the second housing part are manufactured separately from each other, and wherein the second housing part is arranged in an aperture in a casing wall of the first housing part.

3. The burner according to claim 2, wherein the first housing part has a circular cross-section.

4. The burner according to claim 2, wherein the second housing part has a cross-section with a C-shaped profile.

5. The burner according to claim 2, wherein the fresh-air feeder has a sleeve-shaped fresh-air feed chamber, wherein the fresh-air feed chamber radially encloses the first housing part, and wherein the second housing part projects radially through the fresh-air feed chamber.

6. The burner according to claim 1, wherein the bulge extends in a circumferential direction of the main portion over a circumferential angle of 10° to 50°.

7. The burner according to claim 1, wherein an axial extension of the bulge is smaller than an axial extension of the main portion.

8. The burner according to claim 1, wherein a ratio of a volume of the main portion to the volume of the bulge is 200:1 to 50:1.

9. The burner according to claim 1, wherein a yaw angle of the ignition is in an angular range that begins with 0° and ends with 45°, wherein the yaw angle describes a rotation of a longitudinal center axis of the ignition relative to a longitudinal center axis of the main portion about a vertical axis, which is aligned perpendicularly to the longitudinal center axis of the main portion and runs through the longitudinal center axis of the main portion and through the ignition.

10. The burner according to claim 1, wherein a pitch angle of the ignition is in an angular range that begins with 0° and ends with 70°, wherein the pitch angle describes a rotation of a longitudinal center axis of the ignition relative to a longitudinal center axis of the main portion about a transverse axis which is aligned perpendicularly to the longitudinal center axis of the main portion and the vertical axis and runs through the ignition.

11. The burner according to claim 1, wherein the ignition element is arranged such that a longitudinal center axis of the ignition is aligned in parallel with a longitudinal center axis of the main portion.

12. The burner according to claim 1, wherein the housing has a rounding at at least one transition from the main portion to the bulge.

13. The burner according to claim 1, wherein the ignition is a ceramic glow plug.

14. The burner according to claim 1, wherein the fuel feeder and the fresh-air feeder together form a two-fluid nozzle.

15. An exhaust-gas aftertreatment system for an internal combustion engine, comprising:

a burner, including:

a housing forming a combustion chamber, the housing having an outlet which is or can be connected to an exhaust-gas line of the exhaust-gas aftertreatment system, a fuel feed device configured to feed fuel into the combustion chamber, a fresh-air feed device configured to feed fresh air into the combustion chamber, and an ignition element configured to ignite a fresh-air/fuel mixture located in the combustion chamber, wherein the housing is configured such that the combustion chamber has a cylindrical main portion and a bulge protruding radially outward from the main portion, and the ignition element is arranged in the bulge, wherein the combustion chamber is configured such that a fresh-air/fuel mixture introduced into the cylindrical main portion flows in a swirl flow, and the bulge is configured to generate a recirculation flow that rotates in the opposite direction relative to the swirl flow.

* * * * *